United States Patent [19]

Cooper

[11] Patent Number: 4,844,328

[45] Date of Patent: Jul. 4, 1989

[54] WRAP-AROUND CARTON WITH FLANGE-RECEIVING SLOTS

[75] Inventor: Leonard M. Cooper, West Monroe, La.

[73] Assignee: Manville Corporation, Denver, Colo.

[21] Appl. No.: 188,515

[22] Filed: Apr. 29, 1988

[51] Int. Cl.[4] ..... B65D 5/04; B65D 65/12

[52] U.S. Cl. ..... 229/40; 206/427

[58] Field of Search ..... 229/40; 206/427, 434, 206/140, 148; 220/23.4

[56] References Cited

U.S. PATENT DOCUMENTS

| | | | |
|---|---|---|---|
| 2,912,104 | 11/1959 | Fink | 229/40 |
| 2,975,891 | 3/1961 | Stone | 229/40 |
| 2,986,272 | 5/1961 | Kruse | 206/434 |
| 3,006,530 | 10/1961 | Forrer | 229/40 |
| 3,747,835 | 7/1973 | Graser | 229/40 |
| 3,756,394 | 9/1973 | Huault | 206/148 |
| 4,416,411 | 11/1983 | Desmond et al. | 229/40 |
| 4,596,356 | 6/1986 | Chaussadas | 229/40 |
| 4,611,754 | 9/1986 | Sutherland | 229/40 |

FOREIGN PATENT DOCUMENTS

| | | | |
|---|---|---|---|
| 972726 | 8/1975 | Canada | 206/434 |
| 251712 | 2/1964 | Netherlands | 229/40 |
| 1340792 | 12/1973 | United Kingdom | 206/427 |

*Primary Examiner*—Gary Elkins

*Attorney, Agent, or Firm*—John D. Lister

[57] ABSTRACT

A wrap-around carton containing articles having outwardly extending flanges. The top panel is connected to the side panels along fold lines comprised of spaced short lengths of fold lines. The spaces between the lengths comprise slots through which the flanges of articles protrude, and the top panel includes tabs which extend beyond the slots to overlie the protruding flanges. The tabs and slots are formed in carton blanks by slits in the side panel sections which extend into the top panel section.

1 Claim, 2 Drawing Sheets

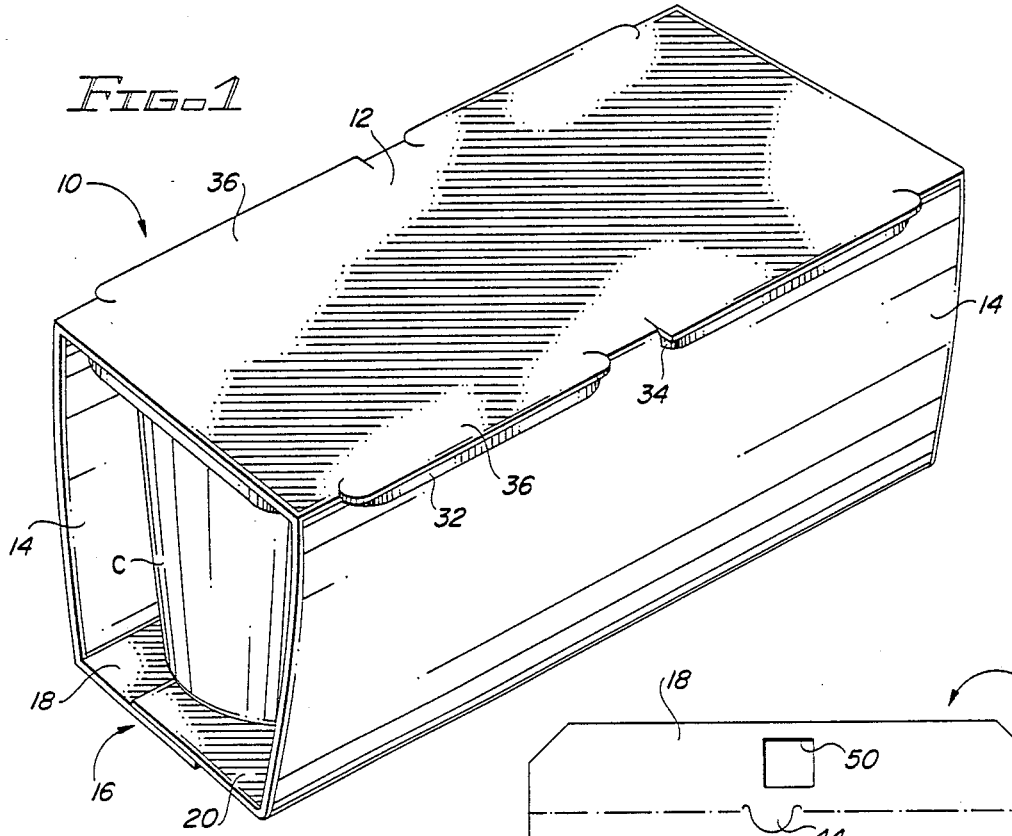
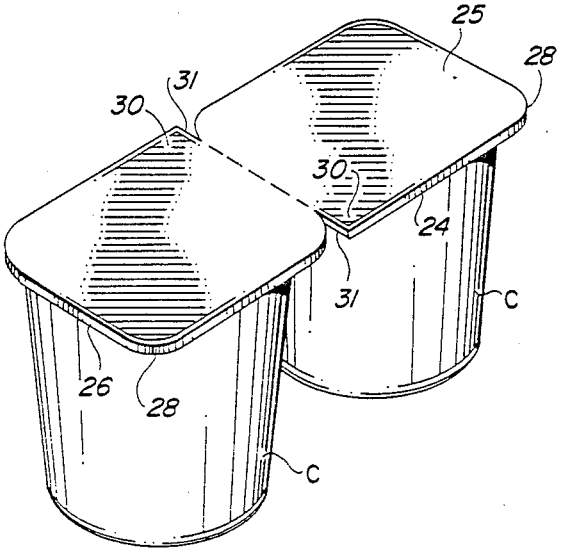
FIG. 2
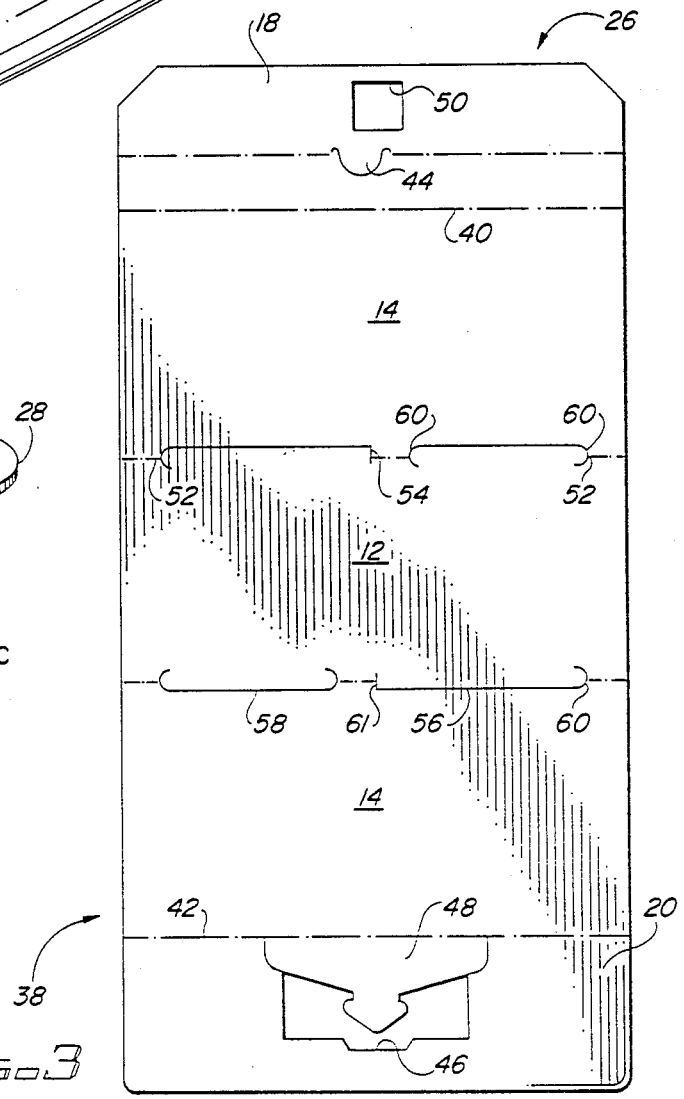
FIG. 3

WRAP-AROUND CARTON WITH FLANGE-RECEIVING SLOTS

FIELD OF THE INVENTION

This invention relates to wrap-around cartons. More particularly, it relates to wrap-around cartons for packaging articles which have outwardly extending flanges.

BACKGROUND OF THE INVENTION

Wrap-around cartons are commonly used to package various types of articles. In particular, the wrap-around carton forming process, which involves wrapping or forming carton blanks about articles while the articles and blanks move at high speeds through a packaging machine, lends itself to packaging articles having outward projections. Preformed cutouts in the carton blank receive the projections when the blank is folded about the article, resulting in a carton having side panels through which the projections of the article extend. Examples of articles packaged in this manner are food containers, such as plastic butter tubs, whose lids extend through cutouts in wrap-around cartons.

In such arrangements the cutouts are normally oversized to enable the carton blank to be easily folded about the articles without snagging on the projections. The cutouts in the resulting package, however, allow dirt to enter the package, which tends to produce a negative reaction in the consumer when the articles are removed from the carton. In addition, the formation of cutouts in the blanks requires removal of material from the blanks, which causes unwanted dust and scrap removal problems. If, however, the blank forming operation is flawed and the cutouts are not entirely removed, the carton forming process will be hindered. Further, some articles have projections of special shape, such as square-cut ends, which the usual cutouts are not adapted to hold tightly in place.

It would be desirable to package articles in wrap-around cartons formed from blanks which do not contain open cutouts but which nevertheless contain provisions for receiving the article projections. It would also be desirable to be able to snugly hold the projections in place, including projections having straight edges as opposed to the usual arcuate edges presented by plastic container lids.

SUMMARY OF THE INVENTION

This invention provides a wrap-around carton blank which has two side panel sections connected to a top panel section along fold lines. Each fold line comprises at least two aligned and spaced relatively short fold line segments separated by a slit. The slit comprises a main portion located in the adjacent side panel section and being substantially parallel to and spaced from the fold line.

In a carton formed from the blank the portion bounded by the slit comprises a tab integral with the top panel and extending outwardly beyond the adjacent side panel, the portion of the blank formerly occupied by the tab comprising a slot through which the flange of an article extends. Thus the slot for receiving the flange is formed from a slit arrangement which does not require the removal of blank material as does the creation of a cutout.

In a preferred embodiment one of the slits may have an end portion which crosses the fold line between the top panel and the side panels and substantially forms a right angle with the slit to form an edge of the associated slot. The edge is adapted to snugly receive a straight flange edge protruding through the slot at substantially right angles to the fold line.

Other features and aspects of the invention, as well as other benefits of the invention, will be ascertained in the more detailed description of the invention which follows.

BRIEF DESCRIPTION OF THE DRAWING

FIG. 1 is a partial pictorial view of carton incorporating the present invention, shown with articles packaged therein;

FIG. 2 is a pictorial view of the type of article packaged in the carton of FIG. 1;

FIG. 3 is a plan view of a production blank for forming the carton of FIG. 1;

DESCRIPTION OF THE INVENTION

Figure 4:
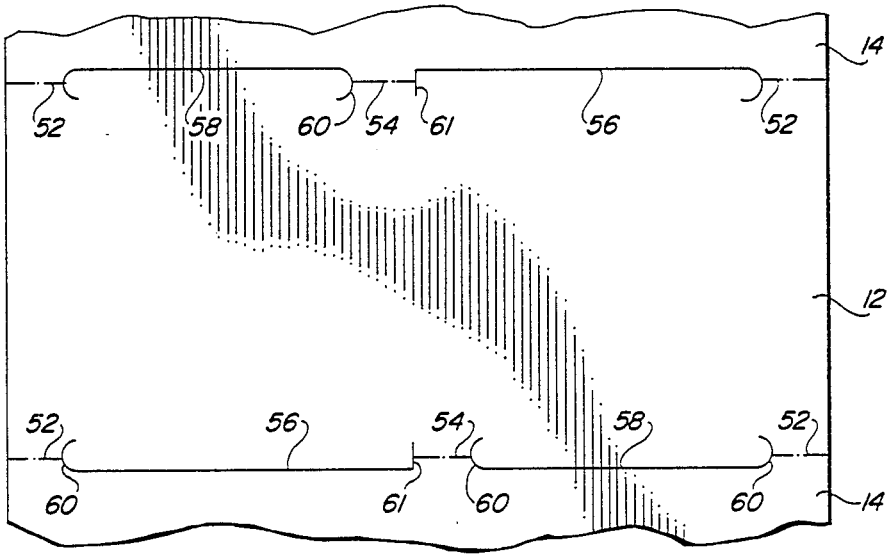
FIG. 4 is an enlarged partial plan view of the central portion of the blank of FIG. 3.

Referring to FIG. 1, a wrap-around carton 10 is comprised of a top panel 12, side panels 14 and a bottom panel 16. The bottom panel is typically comprised of two overlapping bottom panel flaps 18 and 20 which are connected by suitable mechanical locking means. The articles illustrated as being packaged in the carton are food containers C comprising plastic tubs of the type often used to hold pudding.

As shown in FIG. 2, tubs of this type are often sold in connected pairs adapted to be snapped apart along a fracture line 22. Each tub includes a flange 24 which extends outwardly from the tub portion of the container, and a foil 25 attached to the flange covers the opening of the tub. The flange generally has four straight side edges 26, including the fracture line 22, three of which are connected by rounded corners 28. The fourth corner 30, which includes straight transverse edge 31 aligned with the fracture line 22, is formed as the corner of a rectangle so that a user can readily grasp the corner of the foil 25 overlying the right-angled corner.

As shown in FIG. 1, the flanges 24 of the containers extend through slots 32 and 34 in the upper side panels 14 just beneath the top panel 12. The top panel extends over the flanges in the form of outwardly projecting tabs 36.

Referring to FIG. 3, the carton of FIG. 1 is formed from a blank 38, wherein the side panel sections 14 are connected to the outer bottom flap 18 along fold line 40 and to the inner bottom flap 20 along fold line 42. Any suitable locking arrangement may be incorporated in the bottom flaps to lock the flaps together. For purpose of illustration a primary locking tab 44 in the outer flap 18 is adapted to engage the primary female locking edge 46 in the inner flap 20, and a secondary locking tab 48 in the inner flap 20 is adapted to engage a secondary female locking opening 50 in the flap 18. For a better understanding of the operation of this type of locking arrangement U.S. Pat. Nos. 4,437,606 and 4,597,523 may be consulted.

Referring now to FIGS. 3 and 4, the top panel section 12 is connected to side panel sections 14 by fold lines consisting of relatively short end segments 52 and relatively short central segments 54. The fold line segments at each side of the top panel section 12 are aligned with each other so that the segments at each side act as a single fold line. Thus the side panel sections 14 can be folded about the fold line segments 52 and 54 to form the carton configuration illustrated in FIG. 1.

Still referring to FIGS. 3 and 4, relatively long slits 56 and relatively short slits 58 are located in the side panel sections and are offset a short distance from the line along which their adjacent fold line segments 52 and 54 are aligned. The distance the slits are offset corresponds to the thickness of the flange of the containers to be packaged in the carton formed from the blank. Both ends of the short slits 58 and one end of the long slits 56 are connected to the fold line segments by short arcuate slits 60 which extend into the top panel section 12 a short distance. The other ends of the long slits 56 are connected to the associated central fold line segment 54 by a straight slit 61 which also extends into the top panel section 12 a short distance. When the blank is formed into a carton the straight end slit 61 forms a shoulder against which the straight transverse edge 31 of the container flange abuts.

It will be appreciated that when the blank 38 shown in FIGS. 3 and 4 is folded about the containers, the folding of the side panel sections 14 about the fold lines 52 and 54 moves the side panel sections adjacent the slits 56 and 58 away from the top panel section 12, leaving the portions of the top panel section adjacent the slits in place to form the tabs 36 referred to in connection with the carton of FIG. 1. Thus in the carton shown in FIG. 5, the flanges 24 of the containers C are covered by the portions of the top panel 12 which form the tabs 36. Further, the slots or openings 34 in the upper edge portion of the side panels 14 directly beneath the tabs 36 correspond to the space vacated by the upper panel 12 between the slits 56 and 58 and the line along which the fold lines 52 and 54 are aligned. Thus the amount that the slits 56 and 58 are offset from the line of alignment equals the height of the slots 32 and 34.

Figure 5:
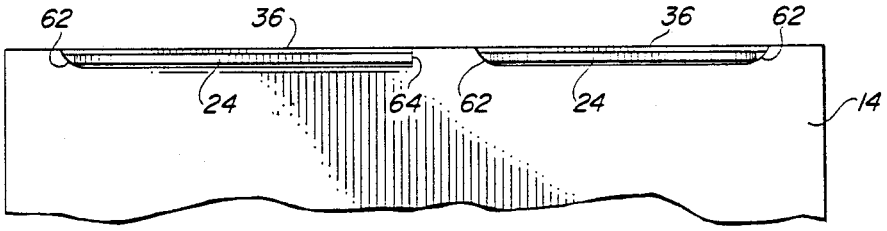
FIG. 5 is an enlarged partial side elevation of the carton of FIG. 1, showing the top portion thereof.

The ends 62 of the slots 32 shown in FIG. 5 are curved and correspond in shape to the lower portion of the arcuate slits 60. This shape is well suited for receiving the straight edges of the container flanges which are connected to adjacent flange edges by the curved corners 28, shown in FIG. 2. One end of the slots 34 is also curved in the same manner and is also indicated at 62. The other end of the slots 34 is formed from the straight cut 61 and therefore is formed with a straight edge 64. This edge forms a shoulder which is adapted to conform to and support the straight edge 31 of the container flange shown in FIG. 2. Thus the portions of the flanges that extend through the slots, despite the fact that they are not of uniform shape, are tightly held in place between the slot edges.

Figure 6:
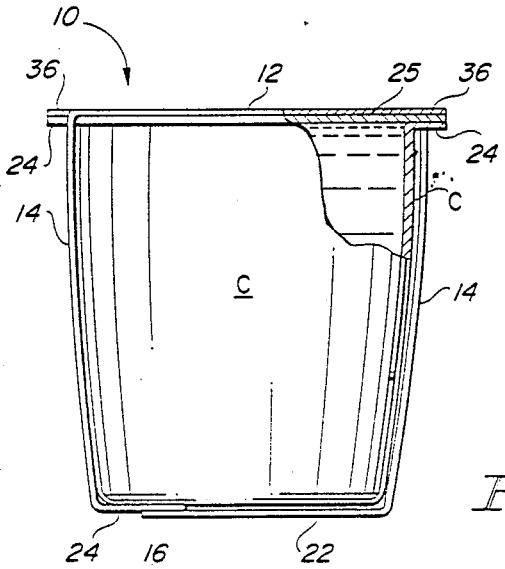
FIG. 6 is a partial end view, shown partially in section, of the carton of FIG. 1.

As shown in FIG. 6, the container flanges 24 are completely covered by the portions of the top panel 12 of the carton which form the tabs 36. The tabs 36 terminate substantially at the ends of the protruding flanges, giving a neat, unified appearance and protecting the flanges and their foil covering from dirt, dust and other unwanted substances.

Although the invention has been described in connection with the containers illustrated in FIG. 2, it will be obvious to those skilled in the art that the concepts of the invention will apply to containers of other shapes as well. Further, the principles of the invention can be applied to cartons adapted to hold only a single container or more containers than two.

It should now be clear that the design of the present invention enables the formation of flange-receiving slots in the side panels of wrap-around cartons without first forming cutout portions in the production blanks, and provides a means for holding the containers tightly in place through the close relationship of the slots and tabs of the carton and the flanges of the containers. Further, by varying the shape of the short transverse cuts or slits which connect the elongated slits to the fold line segments, the ends of the flange-receiving slots can be formed so as to conform to the shape of the container flanges protruding through the slots.

It should be understood that the invention is not necessarily limited to the specific slit and fold line details described in connection with the preferred embodiment. It should further be understood that changes to certain specific features of the preferred embodiment may be made in the practice of the invention without affecting the overall performance and concept of the carton and blank, and without departing from the spirit and scope of the invention, as defined in the appended claims.

What is claimed is:

1. A production blank for forming a wrap-around carton containing adjacent articles, the carton comprising two side panels connected to top and bottom panels along fold lines, each article having a top portion including oppositely directed flanges extending outwardly beyond the side panels of the carton, the outer extremities of such outwardly extending flanges being substantially straight and parallel to the side panels of the carton, the production blank comprising:

two side panel sections connected to a top panel section along fold lines;

each fold line comprising two relatively short end fold line segments and a relatively short intermediate fold line segment, each end segment being separated from the intermediate fold line segment by a relatively long slit, the end and intermediate fold line segments being aligned with each other;

each slit comprising a relatively long continuous straight main portion located in the side panel section connected to the associated fold line and relatively short end portions crossing such fold line and extending into the top panel section;

the relatively long continuous straight main portion of each slit being substantially parallel to and spaced from the fold line a distance substantially equal to the distance that the flanges of the top portion of the packaged articles extend outwardly beyond the side panels of the carton, so as to substantially cover the outwardly extending flanges in such a carton, said spacing further being slightly greater than the thickness of the flanges;

one of the end portions of one of the slits forming a right angle with the main portion of the slit to form a slot edge in a carton formed from the blank which is adapted to snugly receive a straight flange edge protruding through the slot at substantially right angles to the outer extremity of the outwardly extending flanges and at substantially right angles to the associated fold line.

* * * * *